United States Patent [19]

Suzuki

[11] Patent Number: 4,687,975

[45] Date of Patent: Aug. 18, 1987

[54] MOTOR CONTROL WITH RADIO CONTROL DEVICE

[75] Inventor: Nobuhiro Suzuki, Mobara, Japan

[73] Assignee: Futaba Denshi Kogyo Kabushiki Kaisha, Mobara, Japan

[21] Appl. No.: 895,817

[22] Filed: Aug. 12, 1986

[30] Foreign Application Priority Data

Aug. 27, 1985 [JP] Japan ..... 60-130558[U]

[51] Int. Cl.[4] ..... H02P 1/22

[52] U.S. Cl. ..... 318/261; 318/16

[58] Field of Search ..... 318/16, 256, 261, 280, 318/283; 340/307, 825.18, 825.69, 825.72

[56] References Cited

U.S. PATENT DOCUMENTS 4,488,094 12/1984 Min et al. ..... 318/16

4,572,996 2/1986 Hanschke et al. ..... 340/825.69 X 4,584,504 4/1986 Lee et al. ..... 340/825.69 X

*Primary Examiner*—William M. Shoop, Jr.

*Assistant Examiner*—BenBu Ro

*Attorney, Agent, or Firm*—Oblon, Fisher, Spivak, McClelland & Maier

[57] ABSTRACT

A motor control device for a radio control system is disclosed. The motor control device is mounted on an object to be controlled so as to adjust a control range in each of forward, braking and backing of the object. The motor control device is provided with a variable reference signal source for generating a backing reference signal and a comparator for discriminating a region of control element on a transmitter side by comparing a braking-backing command signal generated from a drive control circuit with the backing reference signal. The control range can be adjusted by adjusting a level of the backing reference signal of the variable reference signal source.

2 Claims, 6 Drawing Figures

B
CHANNEL DECODER
9
9a
S2
DRIVE CONTROL CIRCUIT
10
10a
10b
S3
S4a
BRAKING-BACKING AMPLIFIER
11A
FORWARD AMPLIFIER
12
LPF
14
COMPARATOR
16
S4b
VARIABLE REFERENCE SIGNAL SOURCE
17
S5
15
15a
15b
15c
15m
13
M
$V_B$
$V_S$
$i_1$
$i_2$
$i_3$

MOTOR CONTROL WITH RADIO CONTROL DEVICE

BACKGROUND OF THE INVENTION

1. Field of the Invention

This invention relates to a motor control device for a radio control system which is adapted to determine a switching level of rotational direction of a servomotor mounted on a controlled object as desired, and more particularly to a motor control device which is adapted to set an inversion level of the servomotor depending upon a type of the controlled object such as, for example, a racing type model car, a buggy type model car or the like in remote control of the controlled object to adjust a control range in each of forward, braking and backing of the object as desired.

2. Description of the Prior Art

A radio control system is to cause a receiver mounted on a controlled object such as, for example, a model car or a model plane, or an industrial equipment such as a crane, pump or the like to receive and demodulate radio wave transmitted from a transmitter, to thereby control a rotation angle of a servomotor mechanically connected to an operation section of the controlled object.

The typical radio control system which has been conventionally employed will be described hereinafter with reference to FIGS. 3 to 6.

In the conventional radio control system, a channel signal transmitter A is provided on a transmitter side as shown in FIG. 3, which includes a variable resistor 1 connected between a voltage source VB and a ground VS having a slider element 1*a* connected to a control element 1*b*, an operational amplifier 3 having an inversion input terminal connected to the slider element 1*a* and a non-inversion input terminal connected to a reference voltage source 2, a transmission circuit 4 connected to the amplifier 3, and a transmission antenna 6.

On the other hand, a channel signal receiver B arranged on a receiver side, as shown in FIG. 4, includes a receiving antenna 7, a receiving circuit 8 having an input terminal connected to the receiving antenna 7, a channel decoder 9 connected to the receiving circuit 8 having a first channel signal output terminal 9*a*, and a drive control circuit 10 connected through the output terminal 9*a* to the channel decoder 9 having a braking-forward command signal terminal 10*a* and a forward command signal terminal 10*b*, which are connected to a control terminal of a braking amplifier 11 and a control terminal of a forward amplifier 12, respectively. The channel signal receiver B shown in FIG. 4 is adapted to carry out only forward and braking operations, and the discrimination between the forward and the braking is carried out by the drive control circuit 10.

The amplifiers 11 and 12 are connected in series between a voltage source VB and a ground VS through a connection G therebetween. Also, a motor 13 is connected between the voltage source VB and the connection G in a manner to be in parallel to the braking amplifier 11. The channel signal transmitter A described above is in the form of a handset so that it may be portable, whereas the channel signal receiver B is incorporated in a model car.

In the remote control of a model car, when the control element 1*a* is operated to slidably move the slider element 1*b*, a ratio of resistivity between an upper portion of the slider element 1*b* and a lower portion thereof is varied, which causes an operation voltage S1 supplied to the inversion input terminal of the operational amplifier 3 to be varied. In response to such a variation, a voltage supplied from the reference voltage source 2 to the inversion input terminal of the operational amplifier 3 is subtracted from the operation voltage S1 in the operational amplifier 3 to produce a difference therebetween, which is then amplified and supplied in the form of a command signal S2 to the transmission circuit 4. Subsequently, the command signal S2 is subjected to a signal treatment such as modulation, a channel multiple treatment, power amplification or the like which is general in channel multiple radiocommunication. The treated command signal S2 is allotted to, for example, a first channel signal and carried on a main carrier so as to supply in the form of radio wave from the transmission antenna 6.

FIG. 6 shows relationships between the amount of operation of the control element 1*b* and the command signal S2 which are obtained during the operation described above. More particularly, when the control element 1*b* is upwardly moved in FIG. 3 to increase the operation voltage S1, the command signal S2 tends to be increased in positive polarity so that a forward command region may be formed as indicated P in FIG. 6.

In this instance, when the control element 1*b* is moved to a mechanically central position in its operation range, the command signal S2 is rendered zero if a voltage of the reference voltage source 2 is determined to be $\frac{1}{2}$ VB. Then, an electrically neutral region is realized at the mechanically central position as indicated at Q in FIG. 6.

Whereas, when the control element 1*b* is downwardly moved in FIG. 3 to decrease the operation voltage S1, a polarity of the command signal S2 is changed to a negative side and the negative polarity tends to be decreased. Then, a braking-backing command region is formed as indicated at R in FIG. 6.

The receiving circuit 8 of the channel signal receiver B which receives through the receiving antenna 7 radio wave on which the command signal S2 varied as described above depending upon the amount of operation of control element 1*b* subjects the command signal S2 to a signal treatment such as detection or the like which is general in radiocommunication. Then, in the subsequent channel decoder 9, the command signal S2 is subjected to a further signal treatment which is general in a channel multiple treatment so that a specific channel may be extracted from multiple channels to take out the first channel signal.

Thus, the command signal S2 transmitted as the first channel signal from the channel signal transmitter A is reproduced as it is in the channel signal receiver B, and then supplied to the drive control circuit 10. This causes the drive control circuit 10 to discriminate a polarity of the demodulated command signal S2. When it is determined that the command signal S2 is in a positive polarity region as indicated at P in FIG. 6, a forward command signal S3 is supplied from the forward command signal terminal 10*b* to the control terminal of the forward amplifier 12 and then amplified in the amplifier 12 to cause a normal rotation drive current il to be flowed from the voltage source VB through the motor 13 to the amplifier 12 and then escaped to the ground VS. This causes normal rotation of the motor 13, which results in forward movement of the model car.

Whereas, when the demodulated command signal S2 is in a negative polarity region as indicated at R in FIG.

6, the drive control circuit 10 supplies a braking-backing command signal S4 through the braking-backing command signal terminal 10*a* to the control terminal of the braking amplifier 11 and amplified therein. As a result, a braking current i2 corresponding to the amplified command signal S4, as indicated at dotted lines in FIG. 4, flows from the motor 13 to the amplifier 11 in the counterclockwise direction in FIG. 4 and then returns through the connection G to the motor 13. This causes braking of the motor 13, which results in the model car being stopped.

The circuit of the type which carries out normal rotation or braking of the motor 13 in response to any one of the forward command signal S3 and braking-backing command signal S4 supplied from the drive control circuit 10 as described above has been exclusively used for the conventional model racing car. The channel signal transmitter A for this purpose is generally constructed in such a manner that a range of operation of the control element 1*b*, as indicated at X2 in FIG. 6, is deviated in the upward direction (right direction in FIG. 6) in relation to the electrically neutral region indicated at Q in FIG. 6. This causes the backing command signal region which is unnecessary to be deleted and the forward command region to be substitutedly increased so that the control performance may be improved.

In general, the manner of control is variable depending upon an object model or object equipment, for example, a model racing car of which a speed is enjoyed by an operator, a model ordinary car of which movement is enjoyed by an operator and a model buggy car which is adapted to be operated off-road. In the model racing car, it is required to widely determine an adjustable range of a forward speed and backing is hardly required. Accordingly, it is merely necessary to provide the model racing car with forward and stop (braking) functions. On the contrary, the model ordinary car and buggy car each are required to have a backing function as well as forward and braking functions.

Thus, the motor control device requires the drive control circuit 10, the braking amplifier 11 and the forward amplifier 12 which are different depending upon a type of the model car. For example, the model buggy car or ordinary car is required to have a backing function as well as a braking function. Accordingly, the channel signal transmitter A includes the control element 1*b* having an operation range which is symmetric with respect to the electrically neutral region as indicated at X1 in FIG. 6. Also, the channel signal receiver B to be incorporated in the model car is required to have a circuit structure which is constructed to discriminatively distributes the braking-backing command signal into a braking command signal and a backing command signal and separately execute both signals.

An example of such a circuit structure is shown in FIG. 5. A braking-backing command signal terminal 10*a* of a drive control circuit 10 is connected to a control terminal of a braking-backing amplifier 11A substituted for the braking amplifier 11 in FIG. 4 and is branched on the way to be connected through a low pass filter 14 to one end of an exciter coil 15*a* of a relay 15, the other end of the coil 15*a* being connected to a ground VS. The relay 15 has a movable contact 15*c*, a brake contact 15*b* and a make contact 15*m* connected to one end of the motor 13, a voltage source VB and the ground VS, respectively. The remaining of the circuit of FIG. 5 is constructed in substantially the same manner as that shown in FIG. 4.

The circuit of FIG. 5 functions in substantially the same manner as that of FIG. 4 in connection with a forward command signal S3 generated during remote control of the model buggy car, and the buggy car moves forward. Whereas, when the control element 1*b* of the channel signal transmitter A is moved downwardly or in the left direction in FIG. 6 to supply the command signal S2 of the braking command region occupying an area in proximity to the electrically neutral region in the braking-backing command region R to the channel signal receiver B as indicated at R1 in FIG. 6, the control terminal of the braking-backing amplifier 11A receives a braking-backing command signal S4*a* from the braking-backing command signal terminal 10*a* of the drive control circuit 10 to render the braking-backing amplifier 11A operative. This causes a braking current i2 to be flowed through the brake contact 15*b* of the relay 15 which is still kept at a non-excitation state to the motor 13 in the counterclockwise direction as indicated at dotted lines in FIG. 4 and then returned through the braking-backing amplifier 11A to the motor 13. This leads to braking of the motor 13, resulting in the model buggy car being stopped.

When the control element 1*b* of the channel signal transmitter A is moved upwardly or in the left direction in FIG. 6, the sliding point is moved toward the backing command region R2 positioned below the braking command region R1 or in the left direction in FIG. 6 to reach a boundary point T between both regions R1 and R2. When a boundary command signal S2T corresponding to the point T to be supplied to the channel signal receiver B, the braking-backing command signal S4*a* which has been supplied from the braking-backing command signal terminal 10*a* of the drive control circuit 10 through the low pass filter 14 to the exciter coil 15*a* of the relay 15 reaches a lever of a backing command signal S4*b* selected corresponding to the boundary command signal S2T. Then, the relay 15 is transferred to an excited state through the exciter coil 15*a* after the low pass filter 14 provided the signal S4*a* with some delay time.

This causes the movable contact 15 to jump up to the make contact 15*m* to form a ground circuit on the voltage source VB side of the motor 13 so that a reverse rotation drive current i3 may be flowed from the voltage source VB through the braking-backing amplifier 11A which is rendered operative due to the supply of the command signal at a level of the backing command signal S4*b* to the control terminal thereof to the motor 13 in the direction opposite to a normal rotation drive current i1 as indicated at phantom lines in FIG. 5 and then flowed through the closed make contact 15*m* to the ground.

This leads to the reverse rotation of the motor 13, resulting in backing of the model buggy car.

During the operation, the low pass filter 14, even when the control element 1*b* is moved from an upward forward command region P to the downward backing command region R2 with a high speed, holds the movable contact 15*c* at the brake contact 15*b* for a period of time corresponding to the delay action to cause the flow of the braking current i2, to thereby ensure the braking action. Subsequently, the reverse rotation drive current i3 is flowed through the motor 13 to carry out the reverse rotation of the motor 13 to smooth the switching operation between the forward and the backing. More particularly, the drive control circuit 10 shown in FIG. 5 is adapted to generally separate the control mode of a controlled object into two modes, namely a forward mode and a braking-backing mode, and the discrimination therebetween is carried out by the drive control circuit 10.

Also, the drive control circuit distributes the braking-backing mode to a braking mode and a backing mode. This is carried out by introducing a signal obtained due to the selection of the braking-backing mode in the drive control circuit 10 to the low pass filter 14 to carry out the switching between the braking and the backing depending upon a magnitude of the braking-backing signal. In FIG. 5, the low pass filter 14 acts as a kind of an integrator or capacitor, which is adapted to substantially fail in the generation of an output when the braking-backing output is small and generate an output sufficient to excite the coil of the subsequent relay when it is increased.

However, this causes a level of the switching between the braking and the backing to be unconditionally determined by the low pass filter 14. Accordingly, it is impossible to determine the switching level depending upon a type of a controlled object.

As described above, in the conventional motor control device, the channel signal receiver B must be varied in a circuit structure depending upon a type of the model car, because the model car is divided into a type such as a model racing car which is not required to have a backing function and a type such as a model buggy car which is required to have it. Accordingly, the conventional motor control device has a disadvantage that the manufacture and inspection steps and inventory management are highly troublesome.

Also, in the conventional device, the discrimination as to whether the braking-backing command signal S4*a* is increased to a level of the backing command signal S4*b* in the drive control circuit 10 within the channel signal receiver B is fixedly determined depending upon an intrinsic electrical performance of the relay 15 having the level transferred to an excitation state of the relay 15 or the movable contact 15*c* contacted with the make contact 15*m*. Therefore the boundary command signal S2T, a boundary point T between the braking command region R1 and the backing command region R2, and a boundary position xT corresponding thereto is also fixedly determined.

When the channel signal transmitter A in which a range of operation of the control element 1*b* is deviated to be suitable for use for the model racing car as indicated at X2 in FIG. 6 is to be used for the remote control of the model buggy car, the boundary position xT of the control element 1*b* is determined at an end of the operation range X1 to cause the backing command region X2 to be excessively decreased, resulting in a control performance in the backing being highly deteriorated. Accordingly, the channel signal transmitter A to be operated by an operator must be selected depending upon a type of the model car.

SUMMARY OF THE INVENTION

The present invention has been made in view of the foregoing disadvantages of the prior art.

It was found that the above disadvantages of the prior art such as a complexity in the manufacture and inspection steps and inventory management due to a variation of structure of the channel signal receiver depending upon a type of the model car and a variation of structure of the channel signal transmitter depending upon a type of the model car due to the fixed determination of boundary position of the control element of the channel signal transmitter corresponding to the boundary point between the braking command region and the backing command region are eliminated by adjusting, on the channel signal receiver side, a level necessary for the braking-backing signal command signal in the channel signal receiver to be discriminated as the backing command signal. This construction permits a channel signal receiver of the same structure to be used for all kinds of the model car and concurrently applicability of a channel signal transmitter of the same structure to the model car to be highly expanded. For example, this permits a channel signal transmitter having a control element arranged for the model racing car to be applicable to the remote control of the model buggy car.

Accordingly, it is an object of the present invention to provide a motor control device which is capable of being applied to substantially all kinds of a model car.

In accordance with the present invention, there is provided a motor control device comprising a drive control means for receiving a command signal from a transmitter to alternatively generate a forward command signal corresponding to a forward command region of a control element of the transmitter side and a braking-backing command signal corresponding to a braking-backing command region of the control element, a normal rotation drive means for rotating a motor in a normal direction in response to the forward command signal alternatively generated from the drive control means, a backing reference signal generating means for generating an adjustable backing reference signal, a discriminating means to which the braking-backing command signal alternatively generated from the drive control means and the backing reference signal generated from the backing reference signal generating means are supplied for discriminating whether the control element of the transmitter side is in a braking region or a backing region; and a braking-reverse rotation drive means for carrying out braking or reverse rotation of the motor depending upon an output of the discriminating means.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference characters designate like or corresponding parts throughout, wherein:

FIGS. 3 to 6 show a prior art, wherein FIG. 3 is a block diagram showing a channel signal transmitter, FIG. 4 is a block diagram showing a channel signal receiver for a model racing car, FIG. 5 is a block diagram showing a channel signal receiver for a model buggy car, and FIG. 6 is a diagrammatic view showing the formation of a forward command region P, a braking command region R1 and a backing command region R2 due to the operation of a control element in a channel signal transmitter.

DETAILED DESCRIPTION OF THE PREFERRED EMBODIMENTS

Figure 1:
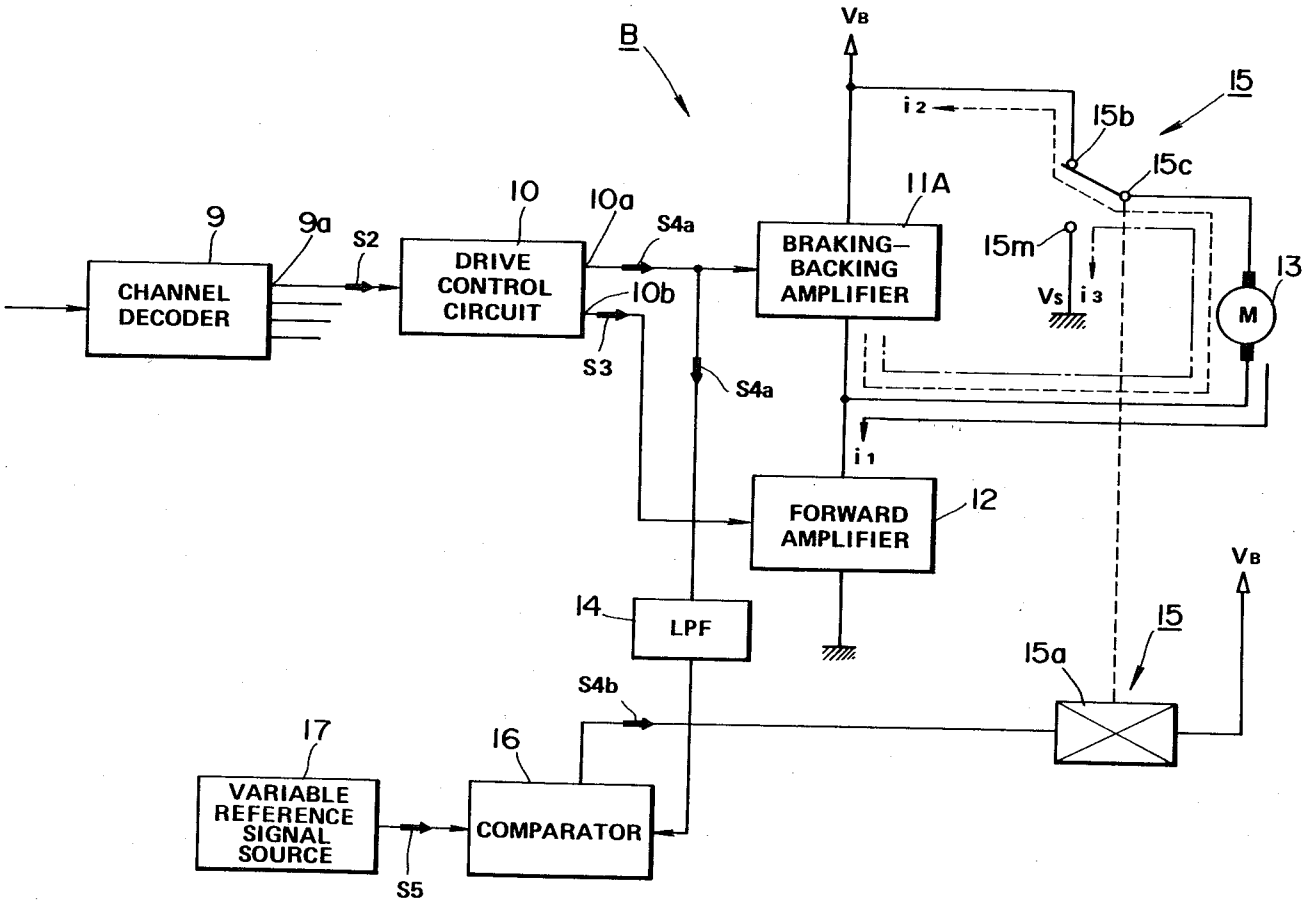
FIGS. 1 and 2 are block diagrams showing an embodiment of a motor control device according to the present invention.

Now, a motor control device according to the present invention will be described hereinafter with reference to FIG. 1.

Figure 5:
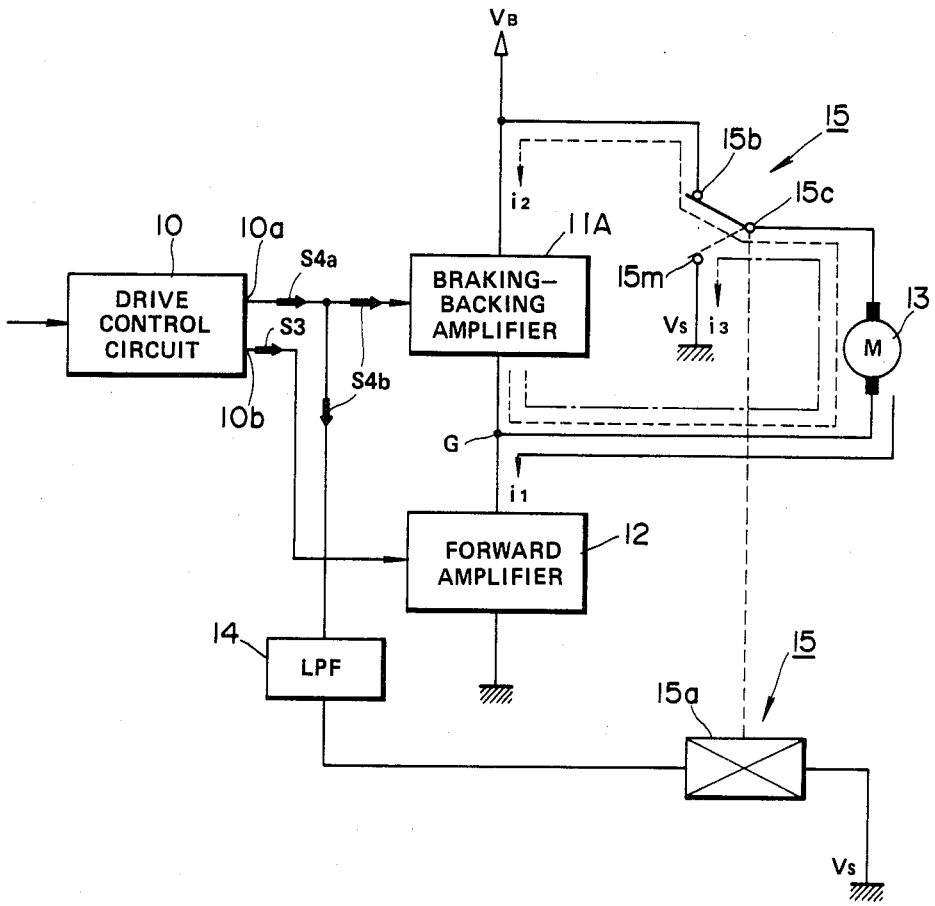
FIG. 5 PRIOR ART

A braking-backing command signal supply terminal 10*a* of a drive control circuit 10 is connected to a control terminal of a braking-backing amplifier 11A acting as a braking-reverse rotation drive means and branched on the way to be connected through a low pass filter 14 to one of input terminals of a comparator 16 serving as a backing command signal discriminating means. The other input terminal of the comparator 16 is connected to an output terminal of a variable reference signal source 17 acting as a backing reference signal adjusting means. An output terminal of the comparator 16 is connected to a voltage source VB through an exciter coil 15*a* of a relay 15 acting as an operation switching means. The remaining of the motor control device of the illustrated embodiment is constructed in substantially the same manner as the conventional device shown in FIG. 5.

The manner of operation of the motor control device of the illustrated embodiment will be described hereinafter with reference to FIG. 1.

In a channel signal receiver B, a braking-backing command signal S4*a* generated from the drive control circuit 10 is supplied to the comparator 16 acting as the backing command signal discriminating means in which the comparison and discrimination between the signal S4*a* and a backing reference signal S5 set at an optimum value by the manual operation in the variable reference signal source 17 are carried out. When it is discriminated that the braking-backing command signal S4*a* is larger than the backing reference signal S5, a backing command signal S4*b* is supplied from the comparator 16 to the relay 15 acting as the operation switching means to switch the manner of operation of the relay 15 to backing to carry out reverse rotation of a motor 13 through the braking-backing amplifier 11A serving as the braking-reverse rotation drive means. This results in a level necessary for the braking-backing command signal S4*a* to be discriminated as the backing command signal S4*b* being manually adjustable every model car so that a boundary command signal S2T corresponding to a boundary point T between a braking command region R1 and a backing command region R2 may be adjustable as desired.

Figure 2:
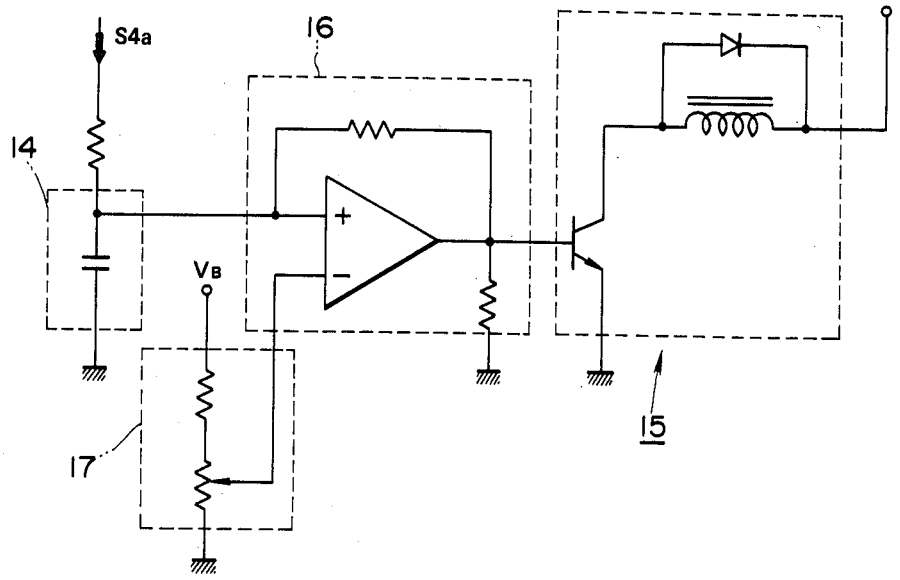
Figure 3:
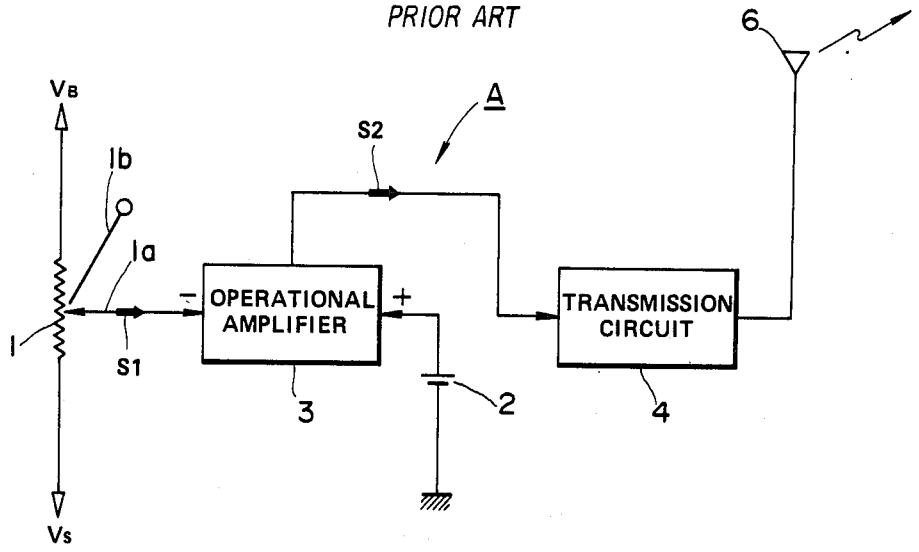
FIG.3 PRIOR ART
Figure 6:
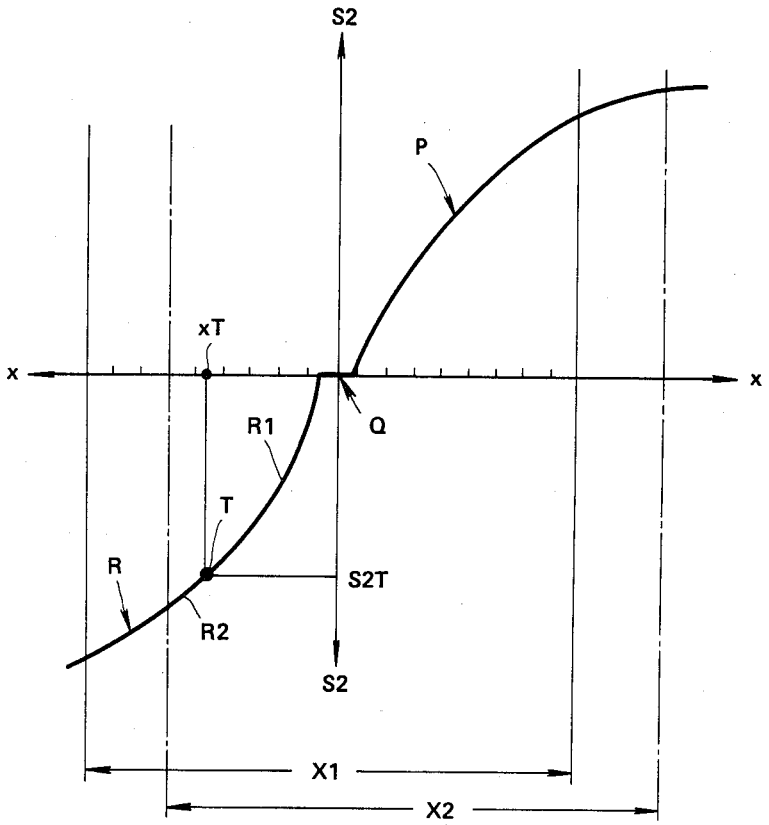
FIG. 6 PRIOR ART

More particularly, when a control element 1*b* of a channel signal transmitter (FIG. 3A) is moved downwardly or in the left direction in FIG. 6 for the purpose of remote control of the model car, the braking-backing command signal S4*a* corresponding to a braking-backing command region (R1 in FIG. 6) is supplied from the braking-backing command signal terminal 10*a* of the drive control circuit 10 to the control terminal of the braking-backing amplifier 11A. In response thereto, the amplifier 11A supplies a braking current i1 via a brake contact 15*b* of the relay 15 to the motor 13, as in the conventional device shown in FIG. 4 or 5. The backing command signal S4*a* is also fed through the low pass filter 14 to one of the input terminals of the comparator 16. Accordingly, when the backing reference signal S5 of a sufficiently high voltage is set in the variable reference signal source 17 and then supplied to the other input terminal of the comparator 16, a negative polarity of the boundary command signal (S2T in FIG. 6) is highly increased equivalently. This causes the boundary point (T in FIG. 6) between the braking command region (R1 in FIG. 6) and the backing command region (R2 in FIG. 6) to be deviated at a large distance in the direction away from an electrically neutral region (Q in FIG. 6), resulting in only the braking command region (R1 in FIG. 6) being in a range of operation of the control element 1*b*. Thus, the supply of a backing command signal S4*b* from the comparator 16 to the relay 15 is not carried out irrespective of a degree of an increase in a negative polarity of the braking-backing command signal S4*a* so that the relay 15 may not be transferred to an excitation state. An example of a combination among the variable reference signal source 17, comparator 16, low pass filter 14 and exciting coil 15*a* is illustrated in FIG. 2.

Figure 4:
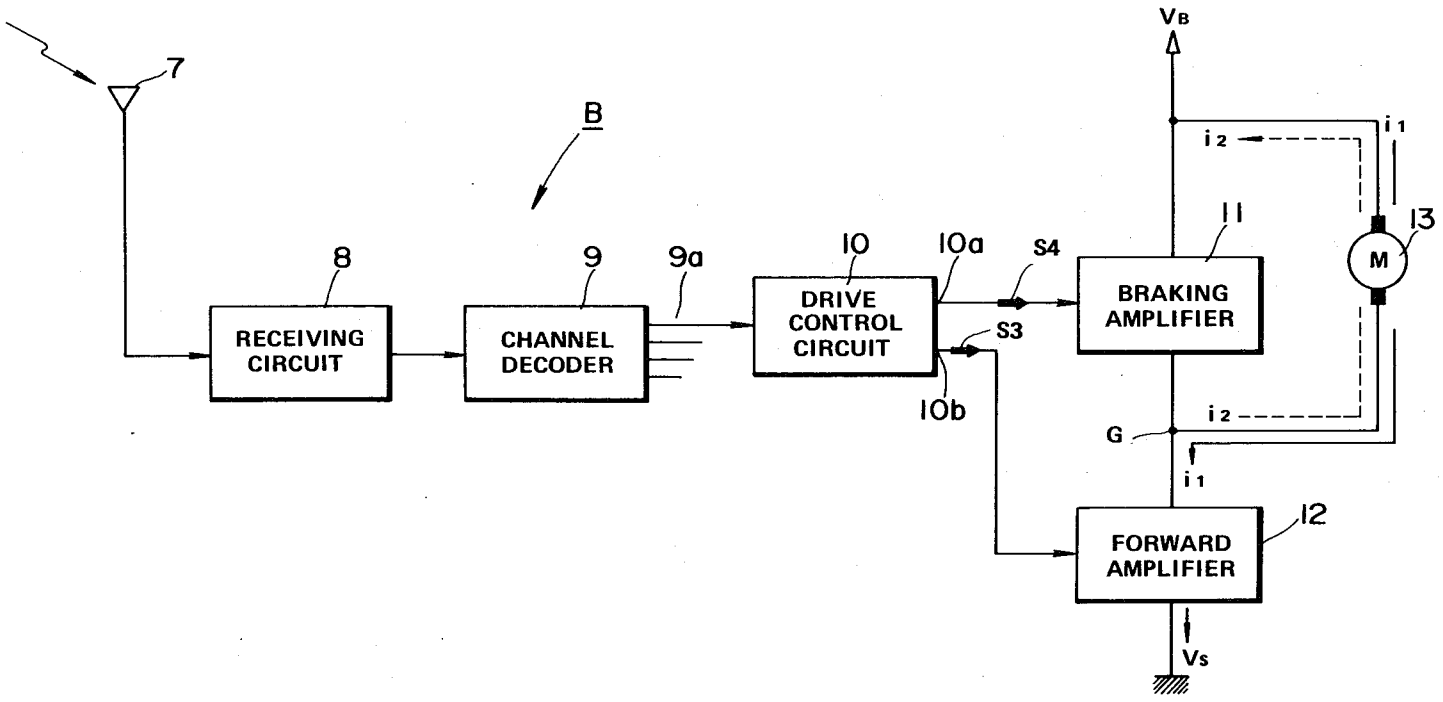
FIG. 4 PRIOR ART

In this instance, the channel signal receiver B acts for the model racing car corresponding to the conventional device shown in FIG. 4.

On the other hand, when the backing reference signal S5 of a considerably low voltage is set in the variable reference signal source 17, the comparator 16 discriminates that the braking-backing command signal S4*a* is increased to a voltage of the backing reference signal S5 due to the downward operation of the control element 1*b*, and supplies the backing command signal S4*b* to the relay 15 to transfer it to an excitation state. This causes a movable contact 15*c* to be contacted with a make contact 15*m*, resulting in the reverse rotation of the motor 13 being carried out as in the conventional device shown in FIG. 5. Thus, in this instance, the channel signal receiver B acts for the model buggy car.

When a transmitter for a model racing car in which a range of operation of a control element 1*b* is deviated to a forward command region side (P in FIG. 6) is used as the channel signal transmitter A to carry out remote control of the model buggy car, the deviation of the boundary point (T in FIG. 6) between the braking command region (R1 in FIG. 6) and the backing command region (R2 in FIG. 6) in a suitable amount toward the electrically neutral region (Q in FIG. 6) is carried out by suitably adjusting a backing command signal level which is determined corresponding to the boundary command signal S2T of the channel signal receiver B side and which is necessary to discriminate the braking-backing command signal S4*a* as the backing command signal S4*b* or a level of the backing command reference signal S5 from the variable reference signal source 17. Thus, the illustrated embodiment permits the channel signal transmitter which has been conventionally used only for the model racing car to secure the backing command region (R2 in FIG. 6) over a wide range which is necessary to control the model buggy car.

As can be seen from the foregoing, the present invention is so constructed that the backing command signal discriminating means 16 is provided in the channel signal receiver B to compare the braking-backing command signal S4*b* with the adjustable backing reference signal S5 supplied from the backing reference signal adjusting means 17, to thereby generate the backing command signal S4*b* from the discriminating means 16 when the braking-backing command signal S4*b* is larger than the backing reference signal S5. Such a construction allows the boundary point T between the control command region R1 and the backing command region R2 to be deviated by the channel signal receiver B or by the control operation carried out on the model car side so that the channel signal receiver of the same circuit structure may secure the braking command region R1 and backing command region R2 as desired by only the adjustment of the receiver. Also, such a receiver is commonly incorporated in all kinds of the model car so that the manufacture and inspection steps and stock control of the model car may be carried out in a highly simplified manner. Further, the present invention is constructed to deviate the boundary point T between the braking command region R1 and the backing command region R2 in a desired amount toward the forward command region side. Accordingly, the backing command region R2 may be widely secured even in the channel signal transmitter A for the model racing car in which a range of operation of the control element 1*b* is deviated to the forward command region side as indicated at X2 in FIG. 6. This permits the channel signal transmitter A for the model racing car to be used for the remote control of the model buggy car, resulting in the applicability of the channel signal receiver A having the same circuit structure being highly increased. Thus, the present invention permits the remote control of the model car to be attained at a three-control mode comprising forward, braking and backing.

In addition, the present invention has another advantage of setting a level of mode transfer from braking to backing as desired. Accordingly, the present invention is applicable to, for example, the model racing car in a manner to decrease a level of the switching between the braking and the backing and substitutedly increase the range of operation of the forward. Further, the present invention accomplishes the conversion of the switching level which allows the backing operation region to be increased when it is applied to the model buggy car.

Thus, it will be noted that the present invention is capable of suitably setting the range of operation of each of the forward, braking and backing depending upon a type of the model car to be controlled.

While a preferred embodiment of the invention has been described with a certain degree of particularity with reference to the accompanying drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A motor control device comprising:

a drive control means for receiving a command signal from a transmitter to alternatively generate a forward command signal corresponding to a forward command region of a control element on said transmitter side and a braking-backing command signal corresponding to a braking-backing command region of said control element;

a normal rotation drive means for rotating a motor in a normal direction in response to said forward command signal alternatively generated from said drive control means;

a backing reference signal generating means for generating an adjustable backing reference signal;

a discriminating means to which said braking-backing command signal alternatively generated from said drive control means and said backing reference signal generated from said backing reference signal generating means are supplied, said discriminating means discriminating whether said control element of said transmitter side is in a braking region or a backing region; and a braking-reverse rotation drive means for carrying out braking or reverse rotation of said motor depending upon an output of said discriminating means.

2. A motor control device as defined in claim 1, wherein said discriminating includes an operation switching means for carrying out braking or reverse rotation of said motor depending upon said output of said discriminating means.

* * * * *